US008973676B2

(12) United States Patent
Grimmer

(10) Patent No.: US 8,973,676 B2
(45) Date of Patent: Mar. 10, 2015

(54) ACTIVE EQUIVALENT CIRCULATING DENSITY CONTROL WITH REAL-TIME DATA CONNECTION

(75) Inventor: Harald Grimmer, Lachendorf (DE)

(73) Assignee: Baker Hughes Incorporated, Houston, TX (US)

( * ) Notice: Subject to any disclaimer, the term of this patent is extended or adjusted under 35 U.S.C. 154(b) by 769 days.

(21) Appl. No.: 13/193,144

(22) Filed: Jul. 28, 2011

(65) Prior Publication Data

US 2013/0025940 A1 Jan. 31, 2013

(51) Int. Cl.
*E21B 21/08* (2006.01)

(52) U.S. Cl.
CPC ..... *E21B 21/08* (2013.01)
USPC ..... 175/48

(58) Field of Classification Search
CPC ..... E21B 21/00; E21B 21/08; E21B 21/10; E21B 2021/006; E21B 44/00; E21B 47/18
USPC ..... 175/324, 57, 25, 48, 38, 50; 73/152.21, 73/152.22
See application file for complete search history.

(56) References Cited

U.S. PATENT DOCUMENTS

| | | | |
|---|---|---|---|
| 2,946,565 | A | 7/1960 | Williams |
| 3,595,075 | A | 7/1971 | Dower |
| 3,603,409 | A | 9/1971 | Watkins |
| 3,677,353 | A | 7/1972 | Baker |
| 3,815,673 | A | 6/1974 | Bruce et al. |
| 3,958,651 | A | 5/1976 | Young |
| 4,022,285 | A | 5/1977 | Frank |
| 4,049,066 | A | 9/1977 | Richey |
| 4,063,602 | A | 12/1977 | Howell et al. |
| 4,091,881 | A | 5/1978 | Maus |
| 4,099,583 | A | 7/1978 | Maus |
| 4,108,257 | A | 8/1978 | Sizer |
| 4,134,461 | A | 1/1979 | Blomsma |
| 4,137,975 | A | 2/1979 | Pennock |
| 4,149,603 | A | 4/1979 | Arnold |
| 4,210,208 | A | 7/1980 | Shanks |
| 4,223,747 | A | 9/1980 | Marais |

(Continued)

FOREIGN PATENT DOCUMENTS

WO 2010071656 A1 6/2010

OTHER PUBLICATIONS

Allen, "Step-Change Improvements with With Wired Pipe Telepathy," IADC/SPE 119570, Mar. 2009.

(Continued)

*Primary Examiner* — Daniel P Stephenson
(74) *Attorney, Agent, or Firm* — Mossman, Kumar & Tyler, PC

(57) ABSTRACT

An apparatus uses well devices, both downhole and at the surface, to control at least one condition in a wellbore. The downhole equipment includes flow restriction devices that modulate fluid flow along a wellbore annulus, flow bypass devices that selectively bypass fluid flow from wellbore tubular bore to the wellbore annulus, and downhole sensors that generate information relating to a selected parameter of interest. The surface equipment includes a pump that circulates a drilling fluid in the wellbore. Controllers, which may be downhole and/or at the surface, use sensor information to generate advice parameters or signals that may be used to control the flow restriction devices, the flow bypass devices, and/or the fluid circulation pump.

20 Claims, 2 Drawing Sheets

(56) References Cited

U.S. PATENT DOCUMENTS

| | | | | |
|---|---|---|---|---|
| 4,240,513 | A | 12/1980 | Castel et al. | |
| 4,291,772 | A | 9/1981 | Beynet | |
| 4,310,050 | A | 1/1982 | Bourgoyne, Jr. | |
| 4,368,787 | A | 1/1983 | Messenger | |
| 4,436,166 | A | 3/1984 | Hayatdavoudi et al. | |
| 4,440,239 | A | 4/1984 | Evans | |
| 4,534,426 | A | 8/1985 | Hooper | |
| 4,613,003 | A | 9/1986 | Ruhle | |
| 4,630,691 | A | 12/1986 | Hooper | |
| 4,655,286 | A | 4/1987 | Wood | |
| 4,744,426 | A | 5/1988 | Reed | |
| 4,813,495 | A | 3/1989 | Leach | |
| 5,092,406 | A | 3/1992 | McStravick | |
| 5,150,757 | A | 9/1992 | Nunley | |
| 5,168,932 | A | 12/1992 | Worrall et al. | |
| 5,355,967 | A | 10/1994 | Mueller et al. | |
| 5,472,057 | A | 12/1995 | Winfree | |
| 5,607,018 | A | 3/1997 | Schuh | |
| 5,651,420 | A | 7/1997 | Tibbitts et al. | |
| 5,775,443 | A | 7/1998 | Lott | |
| 6,035,952 | A * | 3/2000 | Bradfield et al. | 175/66 |
| 6,102,138 | A | 8/2000 | Fincher | |
| 6,142,236 | A | 11/2000 | Brammer et al. | |
| 6,189,612 | B1 * | 2/2001 | Ward | 166/250.07 |
| 6,196,336 | B1 | 3/2001 | Fincher et al. | |
| 6,216,799 | B1 | 4/2001 | Gonzalez | |
| 6,276,455 | B1 | 8/2001 | Gonzalez | |
| 6,374,925 | B1 | 4/2002 | Elkins et al. | |
| 6,415,877 | B1 | 7/2002 | Fincher et al. | |
| 7,096,975 | B2 | 8/2006 | Aronstam et al. | |
| 7,114,581 | B2 * | 10/2006 | Aronstam et al. | 175/57 |
| 7,174,975 | B2 | 2/2007 | Krueger et al. | |
| 7,228,918 | B2 | 6/2007 | Evans et al. | |
| 7,243,735 | B2 | 7/2007 | Koederitz et al. | |
| 7,270,185 | B2 | 9/2007 | Fontana et al. | |
| 7,353,887 | B2 | 4/2008 | Krueger et al. | |
| 7,721,822 | B2 | 5/2010 | Krueger et al. | |
| 7,730,967 | B2 | 6/2010 | Ballantyne et al. | |
| 7,775,299 | B2 | 8/2010 | Khan et al. | |
| 7,806,203 | B2 * | 10/2010 | Krueger et al. | 175/57 |
| 7,908,034 | B2 | 3/2011 | Gray | |
| 8,011,450 | B2 | 9/2011 | Krueger et al. | |
| 2003/0066650 | A1 | 4/2003 | Fontana et al. | |
| 2003/0146001 | A1 | 8/2003 | Hosie et al. | |
| 2004/0069504 | A1 * | 4/2004 | Krueger et al. | 166/387 |
| 2004/0178003 | A1 | 9/2004 | Riet et al. | |
| 2004/0206548 | A1 | 10/2004 | Aronstam et al. | |
| 2004/0256161 | A1 | 12/2004 | Aronstam et al. | |
| 2006/0157282 | A1 | 7/2006 | Tilton et al. | |
| 2007/0045006 | A1 | 3/2007 | Krueger et al. | |
| 2008/0210471 | A1 | 9/2008 | Bailey et al. | |
| 2010/0071904 | A1 | 3/2010 | Burns et al. | |
| 2011/0024195 | A1 | 2/2011 | Hoyer et al. | |
| 2012/0305314 | A1 * | 12/2012 | Maida et al. | 175/50 |
| 2013/0025940 | A1 * | 1/2013 | Grimmer | 175/48 |

OTHER PUBLICATIONS

Bandal, "Demonstrating Managed Pressure Drilling with the ECD Reduction Tool," SPE105599, Feb. 2007.

Fredericks, "Managed Pressure Drilling Avoids Losses While Improving Drilling and ECD Management in the Gulf of Thailand," SPE 130316, Feb. 2010.

Hernandez, "Along String Pressure and temerature Measurements in Real-Time; Early Field Use and Resultant Value," SPE 119540, Mar. 2009.

Rommetveit, Experiences from use of a Managed Pressure Drilling & ECD Management System During Drilling of a Challenging HPHT Well, Feb. 2010.

* cited by examiner

ACTIVE EQUIVALENT CIRCULATING DENSITY CONTROL WITH REAL-TIME DATA CONNECTION

FIELD OF THE DISCLOSURE

This disclosure relates generally to oilfield wellbore drilling systems and more particularly to systems that actively control bottomhole pressure or equivalent circulating density.

BACKGROUND OF THE ART

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. A suitable drilling fluid (commonly referred to as the "mud") is supplied or pumped under pressure from a source at the surface down the tubing. The drilling fluid may drive a motor and then exit at the bottom of the drill bit. The drilling fluid returns uphole via the annulus between the drill string and the wellbore inside and carries with it pieces of formation (commonly referred to as the "cuttings") cut or produced by the drill bit in drilling the wellbore.

During drilling, the equivalent circulating density ("ECD") of the fluid in the wellbore plays a role in effective and safe hole formation. ECD refers to the condition that exists when the drilling mud circulates in the well. The friction pressure caused by the fluid circulating through the open hole and the casing(s) on its way back to the surface, causes an increase in the pressure profile along the fluid flow path that is different from the pressure profile when the well is in a static condition (i.e., not circulating). In addition to the increase in pressure while circulating, there is an additional increase in pressure while drilling due to the introduction of drill solids into the fluid. In one undesirable case, the negative effect of the increase in pressure along the annulus of the well can result in fracturing the formation. In another undesirable case, drilling into an over-pressured formation can cause flow of formation fluid or gas into the wellbore creating a kick.

The present disclosure addresses the need to control ECD as well as other needs of the prior art.

SUMMARY OF THE DISCLOSURE

In aspects, the present disclosure provides an apparatus for controlling pressure in a wellbore formed in a subterranean formation. The apparatus may include at least one flow restriction device in the wellbore that modulates fluid flow along an annulus formed between a wellbore tubular and a wellbore wall; at least one flow bypass device in the wellbore that selectively bypasses fluid flow from a bore of the wellbore tubular to the annulus; at least one sensor in the well that generates information relating to a selected parameter of interest; a pump that circulates a drilling fluid in the wellbore; and a controller in communication with the at least one flow restriction device, the at least one flow bypass device, and the at least one sensor. The surface controller uses the information received from the at least one downhole sensor to control at least one of: (i) the at least one flow restriction device, (ii) the at least one flow bypass device, and (iii) the fluid circulation pump.

In aspects, the present disclosure also provides a method for controlling pressure in a subterranean formation. The method may use a drill string that includes at least one flow restriction device being configured to modulate flow along an annulus formed between a wellbore tubular and a wellbore wall, and at least one flow bypass being configured to selectively bypass flow from a bore of the wellbore tubular to the annulus. The method may include: conveying a drill string along the wellbore; estimating at least one parameter of interest in a well using at least one sensor in the well; circulating a drilling fluid in the well using a fluid circulation pump; forming a communication link between a surface controller and the at least one flow restriction device, the at least one flow bypass device, the at least one sensor, and the fluid circulation pump; controlling at least one of the at least one flow restriction device, the at least one flow bypass device, and the fluid circulation pump using the estimated at least one parameter.

Examples of certain features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, reference should be made to the following detailed description of the preferred embodiment, taken in conjunction with the accompanying drawing.

DETAILED DESCRIPTION OF THE DISCLOSURE

Figure 1:
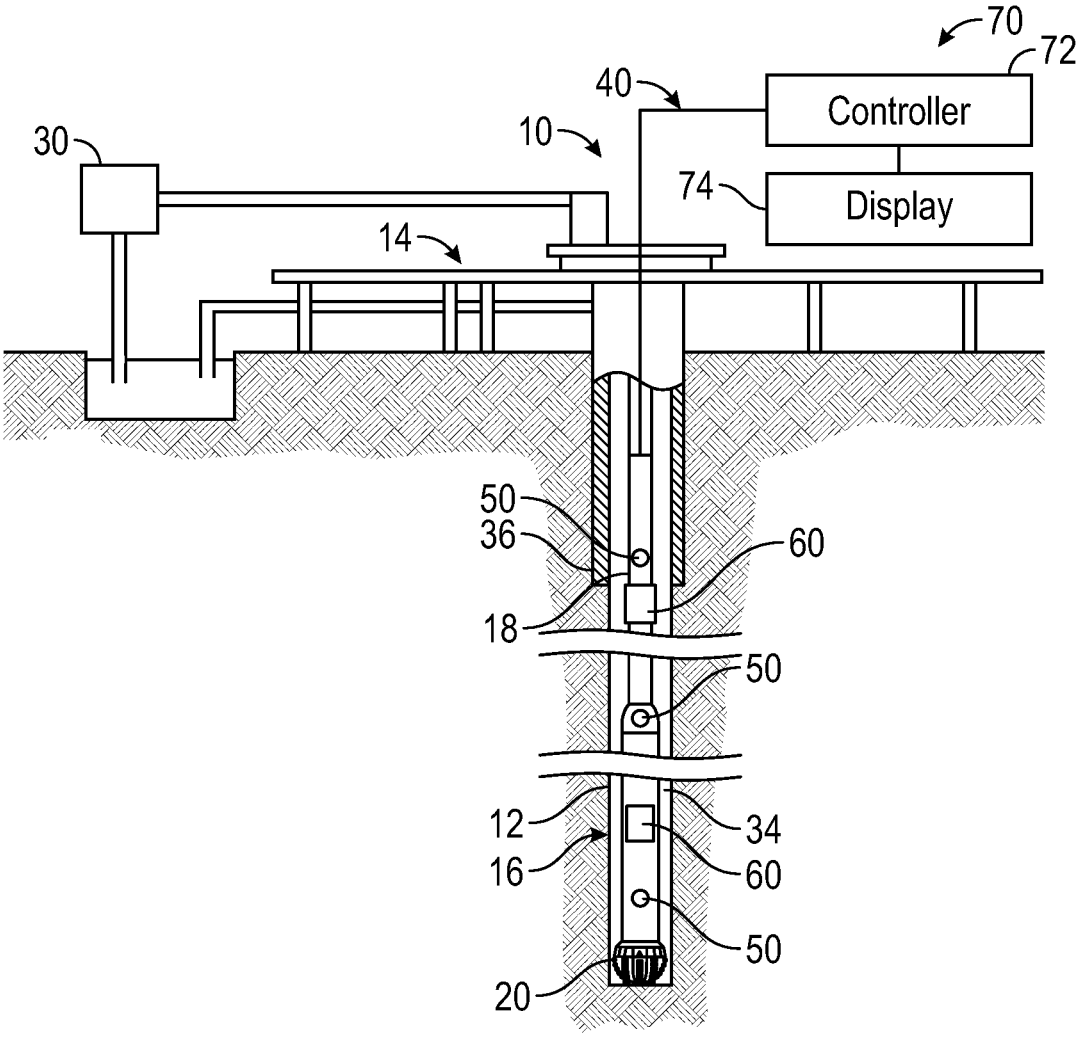
FIG. 1 is a schematic illustration of one embodiment of a system using active ECD control.

Referring initially to FIG. 1, there is schematically illustrated an elevation view of a system 10 for the construction, logging, completion or work-over of a wellbore 12. The wellbore drilling system 10 actively controls equivalent circulating density (ECD) by receiving relevant downhole parameter information, and processing this information to determine what, if any, corrective action is required to maintain a desired well condition. This information may be processed using a surface controller. Thereafter, the surface controller or a human operator may transmit the instructions to one or more downhole flow control devices to obtain the desired well condition. For real-time control, a suitable high bandwidth communication such as "wired pipe" may be used. In other embodiments, other communication system such as mud pulse telemetry may be used. Also, it should be understood that controlling ECD also controls pressure.

In one embodiment, the drilling system 10 may include a rig 14 for land wells or a drilling platform for offshore wells. The system 10 may further include a drilling assembly or a bottomhole assembly ("BHA") 16 at the bottom of a suitable conveyance device such as drill string 18. The BHA 16 may include a drill bit 20 adapted to disintegrate rock and earth. The drill bit 20 can be rotated by a surface rotary drive and/or a downhole motor (e.g., mud motor or electric motor). The drill string 18 can be formed partially or fully of jointed drill pipe, metal or composite coiled tubing, liner, casing or other known wellbore tubulars. Additionally, the drill string 18 may include data and power transmission carriers such fluid conduits, fiber optics, and metal conductors. During drilling, a surface fluid circulation system may use one or more fluid circulation pumps 30 to pump a drilling fluid down the drill string 18. The drilling fluid exits at the drill bit 20 and returns to the surface via an annulus 34 formed between the drill string 18 and a surrounding wall of the wellbore or casing 36.

To actively control ECD and pressure in the wellbore, the system 10 may include a communication link 40 that incorporates high bandwidth communication, one or more downhole sensors 50, and one or more well devices. The well devices many include one or more flow control devices 60 and a surface control system 70.

The communication link 40 may include signal/data carriers or conductors for conveying information encoded signals (e.g., EM, electrical, optical signals, etc.). Illustrative conductors include metal wires and optical fibers. One suitable pipe provided with signal conducting carriers is INTELLIPIPE® pipe, a high-speed drill pipe data communication system offered by IntelliServe Inc. In certain embodiments, the transmission links or paths are bidirectional and allow two-way communication between the devices connected to the communication link 40. In other embodiments, the communication link 40 may use mud pulse telemetry, acoustical signals, or any other suitable well telemetry systems.

Sensors 50 may be strategically distributed throughout the system 10 to generate information or data relating to one or more selected parameters of interest. The downhole sensors 50 communicate with the surface control system 70 via a communication link 40. Illustrative parameters of interest include, but are not limited to, drilling parameters (e.g., rotational speed (RPM), weight on bit (WOB), rate of penetration (ROP)), well parameters such as fluid pressure, pressure in the annulus, pressure in the bore of a wellbore tubular, fluid flow rate, drilling assembly or BHA parameters, such as vibration, stick slip, RPM, inclination, direction, BHA location, fluid composition, formation pore pressure, formation collapse pressure, and/or the formation fracture pressure etc. Illustrative sensors include, but are not limited to, pressure transducers, formation fluid pressure testers, pressure subs, leak off testers, pressure transducers, etc.

Figure 2:
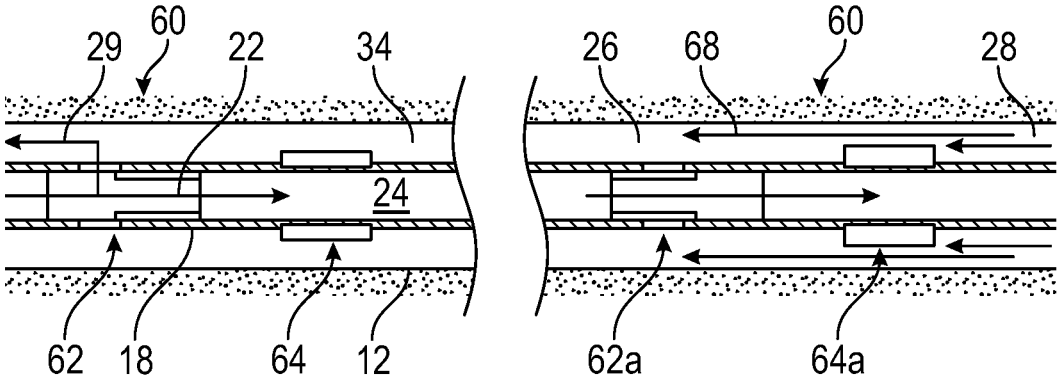
FIG. 2 schematically illustrates exemplary flow control devices that may be used with the FIG. 1 embodiment.

Referring now to FIG. 2, there are shown illustrative flow control devices 60 that may be used to influence ECD in the wellbore 12. The flow control devices 60 may include an adjustable bypass device 62 that allows a selected portion of the fluid 22 flowing downhole in the bore 24 of the drill string 18 to be directed into the annulus 34 and thereby return to the surface without exiting at the drill bit 20 (FIG. 1). Selectively bypassing a certain portion of the total mud flow that would normally flow to and exit out of the drill bit 20 (FIG. 1) will result in a lower total pressure in the wellbore section 26, which is downhole of the bypass device 62. An exemplary flow bypass device may include an adjustable valve, choke, throttle device, a minimum flow controller, or other similar devices that are responsive to signals from the surface controller 72 (FIG. 1). As used herein, the term "bypass" generally refers to bypassing the fluid exit at the drill bit 20 (FIG. 1).

The flow control device 60 may also include adjustable flow restriction devices 64 in the annulus 34. The flow restriction device 64 may selectively modulate the pressure profile of drilling fluid flowing uphole in the annulus 34 by varying (e.g., increasing or reducing) the cross-sectional flow area using an expandable bladder or packer-like device. The flow restriction device 64 may also vary (e.g., increase or reduce) the pressure by altering the flow resistance by causing the returning drilling fluid to take a more tortuous path (e.g., by varying the orientation of blades on a stabilizer). The flow restriction device 64 may include suitable actuators (not shown) for moving, expanding, and/or retracting the elements that control flow (e.g., blades, bladders, channels, etc.). The actuators may be electrically or hydraulically actuated and may be responsive to commands from the processor, which may be in the wellbore or at the surface. Illustrative actuators include, but are not limited to, solenoids, piston-cylinders, electric motors, etc. Activating the flow restriction device 64 in the annulus 34 will result in an increase of the total pressure in the wellbore section 28, which is downhole of the flow restriction device 64. As used herein, the term "modulate" refers to controlling fluid flow within a range that is consistent with a "normal" or desirable fluid circulation in the wellbore 12. However, in combination with appropriate mud weight the flow control device 60 offers the option to modulate the pressure such that drilling at balance is possible. "Modulate" does not refer to restricting fluid flow in order to handle an "out of norm" condition such as a gas kick, but it can help to mitigate the risk. Stated differently, "modulate" does not refer to isolating or substantially isolating a section of a well.

Merely for clarity, the flow bypass device 62 is shown in an open position to direct a fluid portion 29 into the annulus 34. The flow bypass device 62*a* is shown in a closed position to prevent any bypass flow of drilling fluid in the annulus 34. Also, the flow restriction device 64 is shown in a collapsed or retracted position to maximize flow area in the annulus 34. The flow restriction device 64*a* is shown in an actuated position to restrict the flow area in the annulus 34. It should be noted that an annular fluid flow 68 of functional magnitude remains after the flow restriction device 64*a* has been modulated to provide a maximum flow restriction. It should be appreciated that the flow bypass device 62 and the flow restriction device 64 may be configured as devices that provide fixed or variable amounts of flow. Moreover, while two flow control devices 60 are shown, it should be understood that fewer or greater number of flow control devices 60 may be used. Additionally, while a flow restriction is shown paired in close proximity with a flow bypass device, it should be understood that such an arrangement is only one of several possible arrangements.

Referring now to FIG. 1, the surface control system 70 may be configured to control the flow control devices 60 using the information received from the sensors 50 via the communication link 40. The surface control system 70 may use one or more controllers 72 for processing information and a display 74 for displaying this information and proposed instructions to the operator. The controller(s) 72 may contain one or more microprocessors or micro-controllers for processing signals and data and for performing control functions, solid state memory units for storing programmed instructions, models (which may be interactive models) and data, and other necessary control circuits. The controller 72 may also include pre-programmed data from an offset well, a previous drilling run (e.g., pore pressure, collapse pressure and fracture pressure), or from historical databases. While the controller 72 is shown at the surface, the controller 72 may also be located downhole to increase processing speed and enable the system to run independently. Also, controllers 72 may be positioned at the surface and downhole; e.g., the downhole controller provides in situ control and processing and the controller at surface evaluates downhole data and adapts parameters to be sent downhole.

Referring now to FIGS. 1 and 2, during operation, the control system 70 processes information from one or more of the sensors 50 using the controller 72 and according to pre-programmed instructions or algorithms to control the well devices previously described. The controller 72 may include a memory module that includes stored information relating to the "norm" or desirable pressure window for one or more sections of the well 12. For example, the window may include an upper pressure boundary and a lower pressure boundary.

The instructions may also include "norm" or desirable operating boundaries for one or more downhole tools. Varying the flow rate and total pressure may influence the function of tools, drill bit, sensors, etc. as well as the borehole itself (e.g. formation stress, mud cake, etc.) and thus the drilling process. For instance, certain downhole tools may be actuated using the pressurized fluid in the bore 24 of the drill string 18. Illustrative drilling fluid actuated tools include, but are not limited to, devices energized by pressurized fluid (e.g. drilling motors, mud turbines, hydraulic motors, etc.) and devices activated by pressurized fluid (e.g., hydraulically actuated hole enlargement devices such as reamers and underreamers). Further, hole cleaning and lubrication may depend on total drilling fluid flow rate provided by the fluid circulation pump 30. Thus, the controller 72 may be programmed with operating set points or ranges for tools and devices associated with the flow of drilling fluid. As used herein, the term preprogrammed data refers to data programmed into the system 10 before drilling has commenced.

In one illustrative operating mode for controlling ECD/pressure, the controller 72 uses the preprogrammed instructions, the real-time measurements, and pre-programmed data to present drilling information and/or "advice parameter" to an operator. This information and/or advice may be displayed using the display 74. The operator may then, if needed, take steps to influence ECD in relation to formation pressure continuously to stay within a target pressure window. For instance, the operator may send control signals to the adjustable bypass device 62 that directs a portion of the fluid in the bore 24 of the drill string 18 to be directed into the annulus 34. Bypassing a certain portion of the total mud flow will result in a lower total pressure in the lower part of the bore hole. The flow control device 60 may also include adjustable flow restriction devices 64 in the annulus 34. Activating a flow restriction in the annulus 34 instead will result in an increase of the total pressure below it. As both options can be combined the pressure profile along the well bore can be varied. In this manner, the pressure in one or more sections in the wellbore 12 may be controlled while drilling fluid is being continuously circulated and drill bit progresses through the formation.

In another mode of operation, the controller 72 operates in a closed loop fashion. For example, the controller 72 uses the information received from the downhole sensor(s) 50 to compare an estimated measured pressure profile with a preprogrammed desired pressure profile. Thereafter, the controller 72 may issue control signals to control the flow restriction device 64, the flow bypass device 62, and/or the fluid circulation pump 30. These control signals adjust one or more of these devices as needed to obtain the desired pressure profile and are sent to surface via the communication link 40 for verification.

In such operating modes, it should be appreciated that drilling proceeds and is not interrupted by the actuation of the flow control devices 60. That is, the flow control devices 60 are operated in the normal course of drilling as opposed to address an out of norm condition such as a gas kick or fluid loss into a formation. Stated differently, the fluid circulation in the wellbore during and after actuation of the fluid control devices 60 is sufficient to support and is consistent with conventional drilling operations.

While the conductors have been described as suited for carrying data signals, it should be understood in certain arrangements that the conductors can be used to transmit electrical power to one or more downhole devices. Moreover, depending on the particular application, the data links can be unidirectional or bi-directional. Also, the terms "signal" and "data" have been used interchangeably above.

While the foregoing disclosure is directed to certain embodiments of the disclosure, various modifications will be apparent to those skilled in the art. It is intended that all variations within the scope of the appended claims be embraced by the foregoing disclosure.

What is claimed is:

1. An apparatus for controlling pressure in a wellbore formed in a subterranean formation, comprising:

at least one flow restriction device in the wellbore and configured to modulate fluid flow along an annulus formed between a wellbore tubular and a wellbore wall;

at least one flow bypass device in the wellbore and configured to selectively bypass fluid flow from a bore of the wellbore tubular to the annulus;

at least one sensor in the well, the at least one downhole sensor configured to generate information relating to a selected parameter of interest;

a pump configured to circulate a drilling fluid in the wellbore; and a controller in communication with the at least one flow restriction device, the at least one flow bypass device, and the at least one sensor, the surface controller configured to use the information received from the at least one downhole sensor to control at least one of: (i) the at least one flow restriction device, (ii) the at least one flow bypass device, and (iii) the pump.

2. The apparatus of claim 1 where the at least one flow restriction device includes a plurality of flow restriction devices, and the at least one flow bypass device includes a plurality of flow bypass devices.

3. The apparatus of claim 1 where the controller is programmed to estimate a desired pressure increase using the sensor information and to operate the at least one flow restriction device to cause the estimated desired pressure increase downhole of the at least one flow restriction device.

4. The apparatus of claim 1 where the controller is programmed to estimate a desired pressure decrease using the sensor information and to operate the at least one flow bypass device to cause the estimated desired pressure decrease downhole of the at least one flow bypass device.

5. The apparatus of claim 1 where the at least one flow restriction device is one of: (i) an expandable annular member configured to reduce a cross-sectional flow area, and (ii) at least one adjustable flow control element configured to form a tortuous flow path.

6. The apparatus of claim 1 where the at least one flow restriction device includes an actuator responsive to signals from the controller.

7. The apparatus of claim 1 where the at least one flow bypass device includes an adjustable valve responsive to signals from the controller.

8. The apparatus of claim 1 where the controller is further configured to control the at least one flow restriction device, the at least one flow bypass device, and the pump using preprogrammed information relating to one of: (i) an operating parameter of a drilling fluid actuated tool, and (ii) at least one drilling parameter.

9. The apparatus of claim 1 further comprising a communication link that includes at least one signal conductor disposed along the wellbore, the communication link providing signal communication between the controller and the at least one flow restriction device, the at least one flow bypass device, and the at least one sensor.

10. The apparatus of claim 1 wherein the at least one sensor is configured to estimate one of: (i) a pressure in the annulus, (ii) a pressure in a bore of the wellbore tubular, (iii) a pore pressure, (iv) a collapse pressure, and (v) a fracture pressure.

11. The apparatus of claim 1, wherein the controller is programmed to:

estimate a desired pressure increase using the sensor information and to operate the at least one flow restriction device to cause the estimated desired pressure increase downhole of the at least one flow restriction device, and estimate a desired pressure decrease using the sensor information and to operate the at least one flow bypass device to cause the estimated desired pressure decrease downhole of the at least one flow bypass device; and wherein actuation of the at least one flow restriction device does not substantially isolate a section of the wellbore, and wherein the at least one flow restriction device is one of: (i) an expandable annular member configured to reduce a cross-sectional flow area, and (ii) at least one adjustable flow control element configured to form a tortuous flow path.

12. An apparatus for controlling pressure in a wellbore formed in a subterranean formation, comprising:

a wellbore tubular configured to be conveyed along the wellbore;

at least one flow restriction device positioned along the wellbore tubular, the at least one flow restriction device being configured to modulate pressure along an annulus formed between the wellbore tubular and a wellbore wall;

at least one flow bypass device positioned along the wellbore tubular, the at least one flow bypass being configured to selectively bypass flow from a bore of the wellbore tubular to the annulus;

at least one sensor positioned along the wellbore tubular, the at least one downhole sensor configured to generate information representative of a selected parameter of interest;

a communication link being in signal communication with the at least one flow restriction device, the at least one flow bypass device, and the at least one sensor;

a fluid circulation pump configured to circulate a drilling fluid in the wellbore; and a controller in signal communication with the at least one sensor via the communication link, the controller configured to use the information from the at least one sensor to generate at least one advice parameter to obtain a desired pressure in the wellbore, the at least one advice parameter relating to at least one of: (i) the at least one flow restriction device, (ii) the at least one flow bypass device, and (iv) the fluid circulation pump.

13. The apparatus of claim 12, wherein the at least one advice parameter relates to one of: (i) the fluid circulation pump to generate a desired total flow rate into the wellbore, (ii) the at least one flow bypass device to generate a desired flow rate in the bore of the drill string, and (iii) the at least one flow restriction device to generate a desired pressure in the annulus.

14. A method for controlling pressure in a wellbore formed in a subterranean formation, comprising:

conveying a drill string along the wellbore, the drill string including:

at least one flow restriction device being configured to modulate flow along an annulus formed between a wellbore tubular and a wellbore wall, and at least one flow bypass being configured to selectively bypass flow from a bore of the wellbore tubular to the annulus;

estimating at least one parameter of interest in a well using at least one sensor in the well;

circulating a drilling fluid in the well using a fluid circulation pump;

forming a communication link between a surface controller and the at least one flow restriction device, the at least one flow bypass device, the at least one sensor, and the fluid circulation pump;

controlling a well device using the estimated at least one parameter, the well device being selected from one of: (i) at least one of the at least one flow restriction device, (ii) the at least one flow bypass device, and the fluid circulation pump using the estimated at least one parameter.

15. The method of claim 14 further comprising circulating the drilling fluid using the fluid circulation pump after actuating at least one of: (i) the at least one flow restriction device, and (ii) the at least one flow bypass device.

16. The method of claim 14 further comprising estimating a desired pressure increase using the sensor information and operating the at least one flow restriction device to cause the estimated desired pressure increase.

17. The method of claim 14 further comprising estimating a desired pressure decrease using the sensor information and operating the at least one flow bypass device to cause the estimated desired pressure decrease.

18. The method of claim 14 further comprising controlling the at least one flow restriction device, the at least one flow bypass device, and the fluid circulation pump using preprogrammed information relating to one of: (i) an operating parameter of a drilling fluid actuated downhole tool, and (ii) at least one drilling parameter.

19. The method of claim 14 wherein the at least one sensor is configured to estimate one of: (i) a pressure in the annulus, (ii) a pressure in the bore of the wellbore tubular, (iii) a pore pressure, (iv) a collapse pressure, and (v) a fracture pressure.

20. The method of claim 14 further comprising: drilling the wellbore while controlling the well device.

* * * * *